US005255451A

United States Patent [19]

Tong et al.

[11] Patent Number: 5,255,451

[45] Date of Patent: Oct. 26, 1993

[54] INSERT MEMBER FOR USE IN AN ATHLETIC SHOE

[75] Inventors: James K. Tong, San Gabriel, Calif.; David Cousin, Tualaxin; Dan Richard, Portland, both of Oreg.

[73] Assignee: Avia Group International, Inc., Portland, Oreg.

[21] Appl. No.: 754,157

[22] Filed: Sep. 3, 1991

Related U.S. Application Data

[63] Continuation of Ser. No. 284,343, Dec. 14, 1988.

[51] Int. Cl.[5] ..... A43B 13/18

[52] U.S. Cl. ..... 36/30 A; 36/30 R; 36/28

[58] Field of Search ..... 36/30 A, 30 R, 32 R, 36/28, 29, 37, 38; 2/414; 428/179, 180

[56] References Cited

U.S. PATENT DOCUMENTS

| | | | |
|---|---|---|---|
| 495,373 | 4/1893 | Roche . | |
| 545,705 | 9/1895 | MacDonald | 36/29 |
| 1,128,220 | 2/1915 | Bullard | 36/37 |
| 1,387,411 | 8/1921 | Kolkebeck . | |
| 1,498,838 | 6/1924 | Harrison, Jr. . | |
| 1,693,911 | 12/1928 | Schmeer . | |
| 2,090,881 | 8/1937 | Wilson | 36/29 |
| 2,739,093 | 3/1956 | Bull | 36/44 |
| 3,142,910 | 8/1964 | Levine . | |
| 3,589,037 | 6/1971 | Gallagher | 36/44 |
| 3,940,811 | 3/1976 | Tomikawa et al. | 428/179 |
| 4,044,186 | 8/1977 | Stangeland | 428/179 |
| 4,364,188 | 12/1982 | Turner et al. | 36/30 R |
| 4,372,058 | 2/1983 | Stubblefield | 36/32 R |
| 4,432,099 | 2/1984 | Grick et al. | 2/414 X |
| 4,542,598 | 9/1985 | Misevich et al. . | |
| 4,561,195 | 12/1985 | Onoda et al. | 36/30 R |
| 4,598,487 | 7/1986 | Missevich . | |
| 4,733,483 | 3/1988 | Lin | 36/28 |
| 4,768,295 | 9/1988 | Ito | 36/28 |
| 4,774,774 | 10/1988 | Allen, Jr. | 36/28 |
| 4,794,707 | 1/1989 | Franklin et al. | 36/30 R |
| 4,805,319 | 2/1989 | Tonkel | 36/30 R |
| 4,815,221 | 3/1989 | Diaz | 36/28 X |
| 4,864,737 | 9/1989 | Marrello | 36/29 |

FOREIGN PATENT DOCUMENTS

| | | | |
|---|---|---|---|
| 416723 | 7/1925 | Fed. Rep. of Germany | 36/29 |
| 1008102 | 5/1957 | Fed. Rep. of Germany | 428/179 |
| 958766 | 9/1949 | France . | |
| 92894 | 1/1969 | France | 428/180 |
| 2507066 | 6/1981 | France . | |
| 59-10365 | 7/1984 | Japan . | |
| 2114869 | 9/1983 | United Kingdom . | |

OTHER PUBLICATIONS

Cavanagh, Peter R.; The Running Shoe Book; CA, Anderson World, Inc., 1980 p. 184, FIG. 8.12.

*Primary Examiner*—Steven N. Meyers
*Assistant Examiner*—M. D. Patterson
*Attorney, Agent, or Firm*—Sterne, Kessler, Goldstein & Fox

[57] ABSTRACT

An insert member for use in an athletic shoe. The insert member is made of a material which includes a plurality of rows of alternating peaks and valleys.

19 Claims, 4 Drawing Sheets

INSERT MEMBER FOR USE IN AN ATHLETIC SHOE

This application is a continuation of application Ser. No. 07/284,343, filed Dec. 14, 1988.

BACKGROUND OF THE INVENTION

1. Field of the Invention

This invention relates generally to athletic shoes, and more particularly to an apparatus and method for providing increased durability and rebound in athletic shoes.

2. Description of Related Art

A recent surge to provide footwear which is both comfortable and anatomically beneficial has resulted in a plethora of ideas having varying degrees of effectiveness. Most of these ideas are merely variations of ideas which have been around for years. Historically, there have been a number of attempts to increase the cushioning and control of an athletic shoe by making modifications to the midsole, which is that material which generally lies above the outsole. The development of the midsole has led to shoes which take into account the physiology of the foot. The numerous attempts to provide superior cushioning in athletic shoes have led to three broad categories of developments, two of which involve the midsole directly and the third involves modification of the outsole.

The first broad category utilizes different materials and configurations of the midsole to improve cushioning as well as provide effective foot control For example, materials of different hardnesses may be used to provide cushioning and foot control, or a variety of devices may be encapsulated in a midsole to increase cushioning. This type of shoe has the disadvantage of a short life due to breakdown of the materials used to form the midsole. Since many shoes use only ethyl vinyl acetate (EVA) or polyurethane (PU) for cushioning, the cells of these foams have a tendency to break down and thus virtually eliminating the usefulness of the midsole. This in turn can cause serious injuries.

The second category of device utilizes pneumatic devices within the midsole. An example of this is taught in U.S. Pat. No. 545,705, issued to McDonald. The McDonald device is an elastic air filled cushioning device which is incorporated into the heel of a shoe to provide cushioning. A similar device is taught in U.S. Pat. No. 1,498,838 to Harrison Jr. which uses a number of tubes which lie within the midsole. These tubes are inflated by a valve to maintain a pressure above ambient. The tubes in the Harrison Jr. device are made of a flexible inelastic material.

The disadvantages of encapsulating gas within the midsole of a shoe are numerous. It is exceedingly difficult and costly to encapsulate gas in a material. It is much easier, for example, to cut a piece of conventional midsole material such as ethyl vinyl acetate (EVA) to a desired specification than to make a container which retains pressurized air or other gas.

Material puncture is also a problem with pressurized gas midsoles. Even careful material selection does not fully alleviate the problem; the problem of puncture nevertheless exists and the solution to such a problem can add additional manufacturing expense. Yet another serious drawback with this type of shoe is that the pressure of the gas within the encapsulating container is temperature dependent. As such, the stiffness of the shoe varies as the shoe warms up. Similarly, the shoe may respond differently in cold and warm temperatures. Along these same lines, the midsoles are altitude dependent, which means that the shoe will have different support characteristics depending on what altitude it is used at.

Stability is another problem with shoes which encapsulate gas within the midsole. In simple terms, encapsulated gas midsoles are oftentimes too soft to give proper support.

In light of the multitude of problems associated with gas-encapsulated midsoles, it is of great importance to find alternatives which provide both adequate cushioning, stability and support. Such alternatives must be economical and must eliminate the problems of encapsulated tube technology without sacrificing cushioning.

The third broad category of devices which are intended to increase the cushioning of a shoe include outsole configurations. An outsole is typically made of material such as rubber, polyurethane (PU), thermoplastic rubber (e.g., EVA) and the like. These materials are chosen for outsoles because they are wear resistant. Typically, these materials have fairly good memory characteristics. That is, if the outsole material is deformed either by compression or bending forces, it tends to return to its original shape. The best example of a shoe which falls into this third broad category is U.S. Pat. No. 4,372,058 to Stubblefield, which teaches an outsole in which the periphery of the heel of the outsole maintains the remaining portion of the heel of the outsole in a spaced apart relationship to the ground. This configuration is known as a cantilever outsole. The cantilever configuration helps to redirect vertical forces while increasing energy return to the midsole.

In the Stubblefield patent referred to above, an outsole is provided which has a plurality of lugs or levers which extend from the periphery of the bottom of the outsole. These lugs are designed to redirect vertical forces on the outsole so that the forces have at least a horizontal component thereby reducing the stresses on a runner. The Stubblefield patent provides a shoe which provides both cushioning and stability.

Many of the devices described above are directed primarily for cushioning of the heel portion of the midsole, and are not entirely suitable or desirable for use in the forefoot area of an athletic shoe. The present invention, while usable in the heel area of an athletic shoe, has particular advantages when used in the forefoot of an athletic shoe and may in fact be utilized in conjunction with other cushioning devices such as the cantilever orientation of the above-referenced Stubblefield patent.

It is one object of the invention to provide an insert for use in a midsole which provides cushioning and durability.

It is a further object of the invention to provide an insert for use in an athletic shoe which is easily adaptable for use in conjunction with other cushioning or rear foot control devices.

It is yet a further object of the invention to provide an insert which is easily incorporated into an athletic shoe design.

SUMMARY OF THE INVENTION

In accordance with the purposes of the present invention as embodied and described herein, the present invention is an insert member for use in an athletic shoe. The insert member is made of a sheet of material which tends to return to its original shape when bent and is substantially of uniform thickness, having undulations which form a plurality of parallel rows of peaks and valleys. Each row of peaks and valleys is out of phase from an adjacent row of peaks and valleys. In another aspect of the invention, each row of "valleys" is 180° out of phase from the adjacent row of peaks and valleys. In yet another aspect of the invention, the sheet forming the insert member is made of a material such as a thermoplastic polymer.

In yet another aspect of the invention, the insert member comprises a plurality of substantially circular peaks and valleys.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE PREFERRED EMBODIMENTS OF THE INVENTION

Referring to the accompanying drawings, the present invention is a device and system which improves an athletic shoe by increasing its useful life and by improving the memory characteristics thereof. To assist in the understanding of the invention as it is incorporated into the sole of an athletic shoe, the environment of the invention will first be described. FIG. I depicts a sole for an athletic shoe, designated generally as 10, which includes a number of component parts. In the embodiment of the invention shown in FIGS. 1 and 2, the sole 10 includes a midsole 12, which, like most athletic shoes, provides cushioning to the foot of a wearer. The midsole 12 may be made of a material such as ethyl vinyl acetate (EVA) or polyurethane (PU) and may be formed from materials of differing densities. For example, it is sometimes desirable for the medial side of an athletic shoe to be formed of a material having a higher density than that of the lateral side of the shoe. This is done in order to correct for certain biomechanical problems such as pronation. Similarly, many other midsole configurations may be used in conjunction with the invention.

Figure 2:
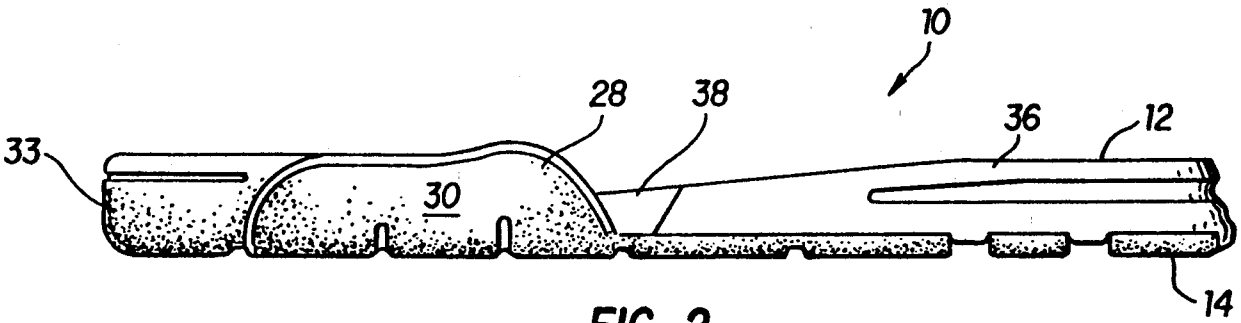
FIG. 2 is a left elevational view of the sole of an athletic shoe which incorporates the invention.

As shown in FIG. 2, also provided on the sole 10 is an outsole 14 for contacting the ground. The outsole 14 may be made of an abrasive resistant material such as rubber and includes a heel portion 16 which has a central heel portion 18 of the outsole 14 which may be in spaced relationship with the ground. This relationship of the central heel portion 18 and peripheral portion of the outsole 14 is known generally as a cantilever outsole, an outsole orientation which is described in detail in U.S. Pat. No. 4,372,058 to Stubblefield. The heel portion 16 has a plurality of lugs 20 around the periphery thereof. These lugs 20 deflect outward upon the application of pressure onto the sole 10 and help to reduce shock to a wearer's foot upon impact with the ground.

Figure 1:
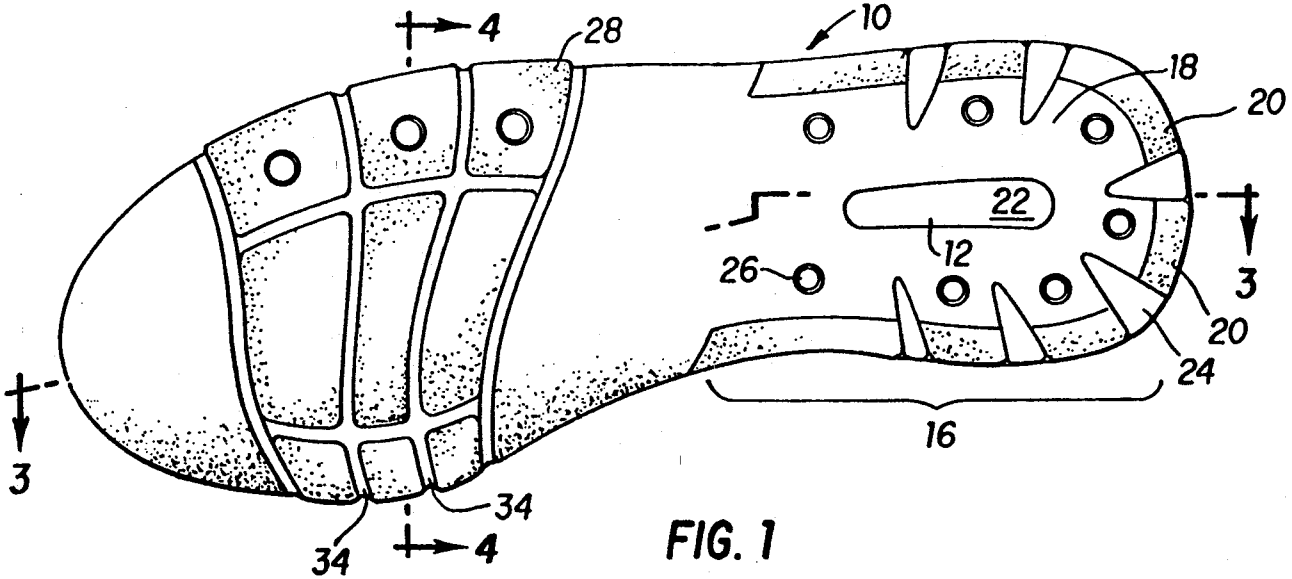
FIG. 1 is a bottom plan view of an athletic shoe which has the invention incorporated therein.
Figure 4:
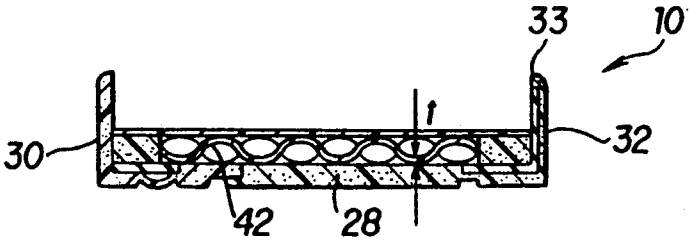
FIG. 4 is a cross-sectional view of FIG. 1 cut along line IV—IV.
Figure 5:
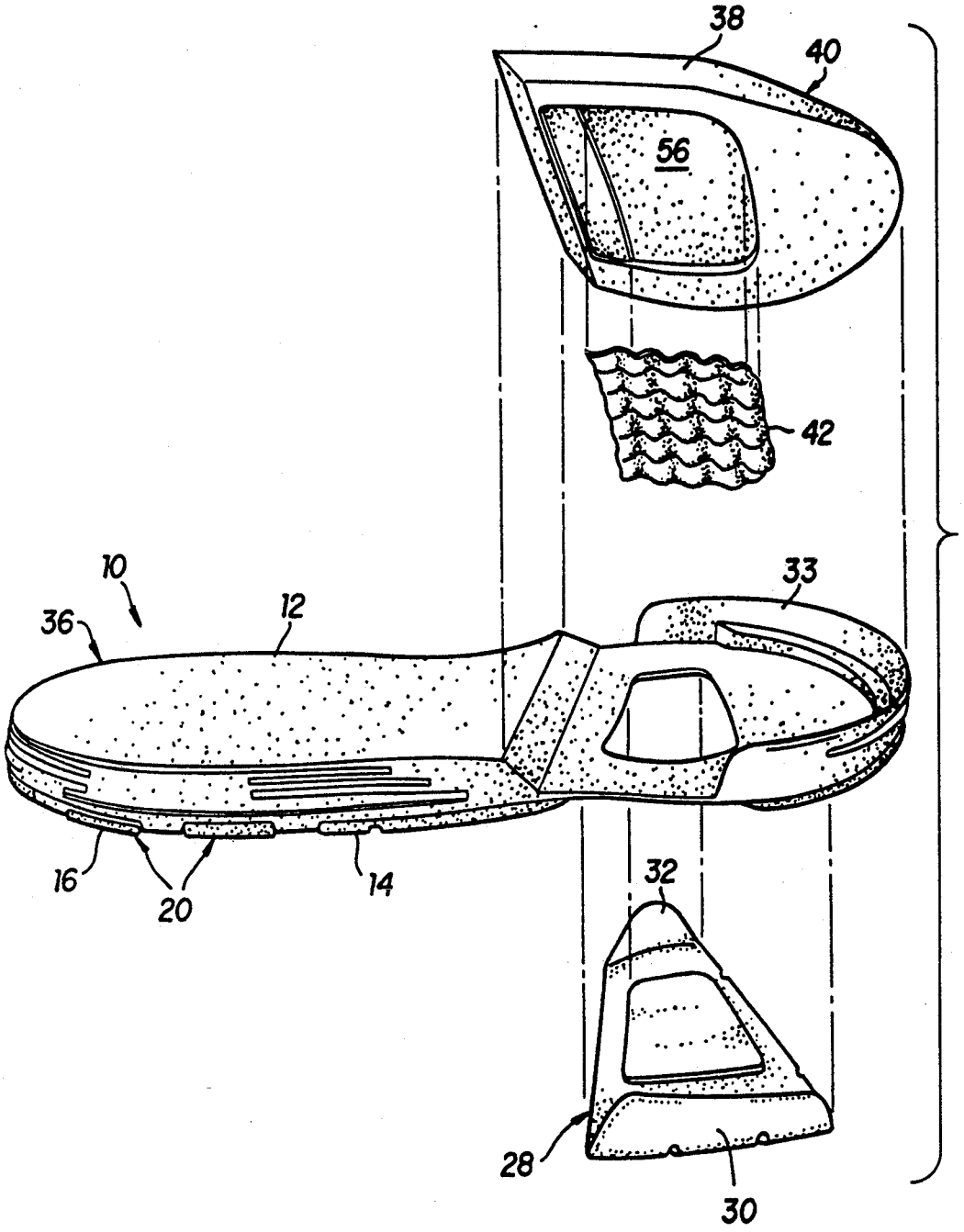
FIG. 5 is an exploded view of the components of one embodiment of the invention.

In the sole shown in FIG. 1 the weight of the outsole 14 has been reduced by providing a central opening 22 which exposes midsole 12; wedge-shaped openings 24 which also help to separate the lugs 20 thereby making lugs 20 move independently of each other; and circular openings 26. In the embodiment of the invention shown in FIGS. 1 and 2 a PU wrap member 28 is provided which is attached adhesively to the remaining portions of the outsole 14. The PU wrap member 28 has a lateral extension 30 which helps to provide stability to the wearer's foot. Also provided on the PU wrap member 28 may be a medial extension 32 which is best seen in FIGS. 4 and 5. This midsole wrap helps provide stability by providing surfaces which tend to prevent excessive pronation or supination. If a conventional toe bumper 33 is used in conjunction with the wrap member 28, the medial extension 32 and lateral extension 30 may wrap over the bumper 33. In the embodiment of the invention shown in FIG. 1, flexure grooves 34 are provided in the PU wrap member 28 in the metatarsal area. These help to provide bending of the sole in the area of the shoe where such bending is necessary in many athletic sports.

In a preferred embodiment of the invention, midsole 12 is provided with a heel component 36 which is made of a cushioning material such as polyurethane (PU). Also provided in the midsole 12 is a forefoot component 38. The forefoot component 38 may include a forefoot foam 40 such as Ethyl Vinyl Acetate (EVA) or PU and may have a Shore C durometer hardness of approximately 50 or 60. Forefoot foam 40 provides cushioning to the forefoot of a wearer.

The invention is the use of a insert member 42 in conjunction with other component parts of an athletic shoe.

Figure 3:
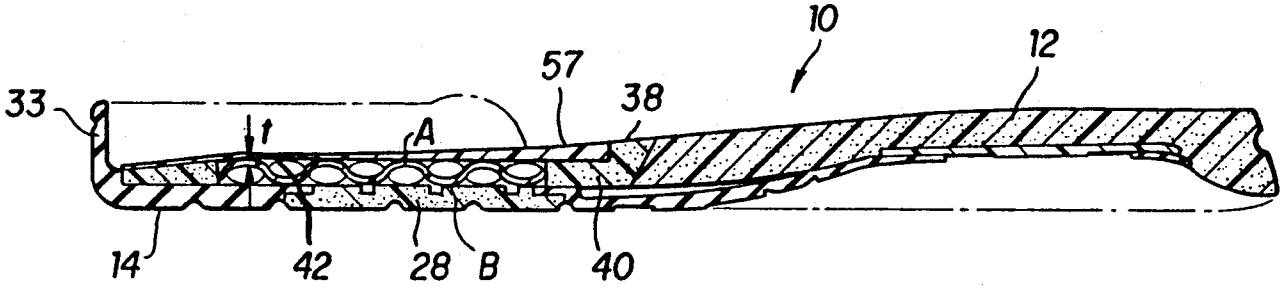
FIG. 3 is a cross-sectional view of FIG. 1 cut along line III—III.
Figure 6:
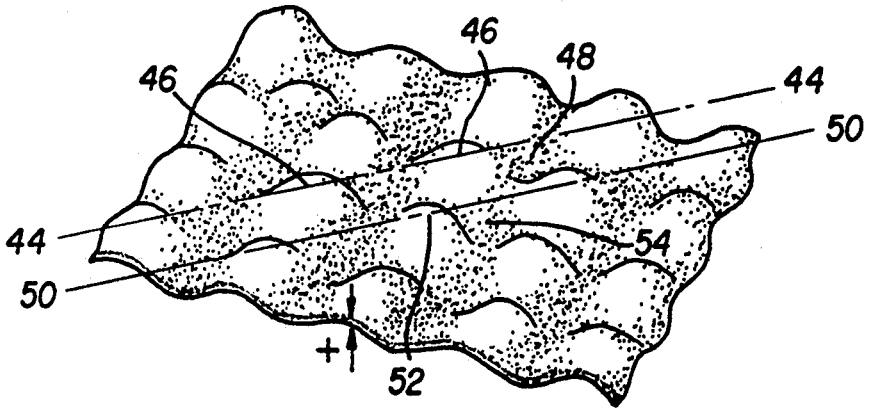
FIG. 6 is a perspective view of a piece of material from which the insert member of the invention is made.

Referring to FIGS. 3–6, the insert member 42 used to practice the invention is illustrated; FIGS. 3–4 show the insert member 42 in cross-section in conjunction with other components of an athletic shoe; FIG. 5 illustrates an exploded view of an athletic shoe embodying the invention; and FIG. 6 depicts a sheet of material from which an insert member 42 may be formed. Even though FIG. 6 is a sheet of material from which an insert member 42 is formed, it will be described below as if it were an insert member 42 since the only difference between the material shown in FIG. 6 and an insert member is that FIG. 6 shows material of arbitrary dimensions.

The geometric configuration of the insert member 42 gives the midsole of an athletic shoe increased life because much of the input energy is absorbed by the insert member rather than by midsole material . In addition, the midsole may be lighter because less midsole material is necessary. Further, the midsole will return quickly to its relaxed configuration.

The insert member 42 is an undulating sheet of material which has a uniform local thickness. This thickness (t) is typically about 1/32" but may be tailored to a particular use. Naturally, the thickness may be greater or less than 1/32" when used in the forefoot. For example, if the invention were to be used in a location other than the forefoot, it may need to have a greater or lesser thickness. Similarly, a non-uniform thickness may be used if different responses are desired for different portions of the insert member. The overall shape of the insert member 42 may, but need not, be substantially rectangular in shape. In the embodiment of the invention shown in FIG. 5, insert member 42 approximates a rectangle with two rounded and two hard corners. The precise overall shape of insert member 42 is not critical and it should be understood that the shape of insert member 42 can be tailored as desired. The material forming the insert member has undulations which form a plurality of rows of substantially circular peaks and valleys. A first row, designated as 44 in FIG. 6, has a cross-section which is substantially sinusoidal. In this configuration, the magnitude of the amplitude of the peaks 46 and valleys 48 is the same and the wavelength of the sinusoidal cross-section is constant. These two geometric characteristics (constant amplitude and constant wavelength) are not critical to the invention and it is anticipated that a number of geometries could be used to practice the invention. Again, referring to FIG. 6, the spacing between peaks 46 in row 44 is approximately 11/16 inch and the magnitude of the amplitude of each peak and valley is approximately 3/32 inch. In other words the thickness of the insert member measured from the maximum peak to the minimum valley is 3/16 inch. Naturally, these values can vary depending on whether the insert 42 is to be used in, for example, the heel of an athletic shoe instead of in the forefoot.

A second row, designated as 50 in FIG. 6, is positioned so that the first row 44 and the second row 50 are juxtaposed at a distance of one-half the distance between adjacent peaks 46 of the first row 44. The second row 50 similarly has peaks 52 and valleys 54. In cross-section, the second row is identical to the first row 44 except that the second row 50 is 180° out of phase from the first row 44. Every second row forming the insert member is in phase and all rows are 180° out of phase with its adjacent row.

Another way of describing the geometry of the insert member is to say that it is formed from a continuous quincunx arrangement. That is, the circular peaks of the insert member are arranged in a quincunx, the four sides of which are the sides of the adjacent quincunx arrangements. There are circular valleys formed between each of the circular peaks forming the corners of each quincunx arrangement.

FIGS. 3 and 5. A frame is provided for the insert member 42 by the forefoot foam 40. In one embodiment of the invention, a cutout is provided in which the insert 42 is positioned. The insert member 42 can be made of many different materials as long as the material or combination of materials forming the insert 42 has good memory characteristics, is durable, and provides cushioning. By good memory characteristics it is meant that the material forming the insert, when deflected tends to return to its original configuration. This return to its original configuration should take place in a time frame which is less than the average period between deflections. For example, in a running shoe, the insert member 42 will deflect each time the foot contacts the ground in the region of the insert member 42. Therefore, it is important that when pressure on the insert member 42 is no longer exerted, the insert return to its original configuration prior to the next time the foot contacts the ground in the region of the insert member 42.

In addition to having good memory characteristics the insert member 42 must be durable. It must be able to constantly withstand the cycling from a mode in which a force is exerted on the insert to a mode in which the insert is relaxed. In addition, the insert 42 must be made of a material which resists cracking due to either impact forces or due to fatigue; and must not have varying properties as a function of change of ambient conditions such as temperature and pressure. One commercially available material which has these characteristics is Hytrel which is the registered trademark of a material which is manufactured by E.I. DuPont de Nemours. Hytrel is a chemically stable, semi-crystalline, fully polymerized, high molecular weight, thermoplastic polyester elastomer having alternate amorphous and crystalline chains.

Hytrel is selected as a material because of its ability to store energy upon impact and return that energy to the source. Hytrel 4056, having a Shore D durometer hardness of 40; Hytrel 4074, also having a Shore D durometer hardness of 40; and Hytrel 8236, having a Shore D durometer hardness of 82, are three materials (all DuPont) which may be used to practice the invention. It should be noted however that many other materials may be used to practice the invention.

The insert member 42 is generally positioned in the forefoot of an athletic shoe to improve the cushioning characteristics of the midsole by providing good memory characteristics and by returning energy to the midsole. The insert member 42, when used in conjunction with forefoot foam 40, is generally positioned within forefoot cavity 56 (FIG. 5). This forefoot cavity 56 may extend completely through the forefoot foam 40 or may only be an indentation in the forefoot foam 40. A cover 57 may be placed above insert 42. Typically, the insert member 42 is cemented in place with a thin film of cement which attaches the crests of the peaks to the other midsole components such as the forefoot foam 40 (see point A, FIG. 3) or the outsole 14 (see point B, FIG. 3).

FIG. 5 is an exploded view of an athletic shoe embodying the present invention. The sole 10 has an outsole 14. Above outsole 14 is a midsole having a heel component 36 and a forefoot component 38. The forefoot component is made up of a forefoot foam 40 having a forefoot cavity 56 in which an insert member 42 as previously described is inserted.

Figure 7:
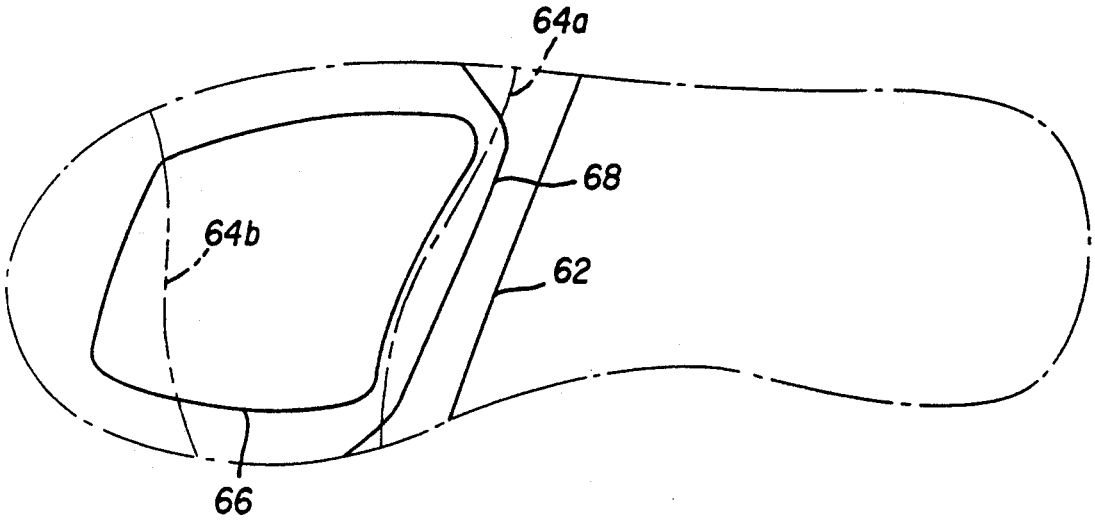
FIG. 7 is a schematic view of one embodiment of the invention showing the component elements superimposed.

FIG. 7 shows a superimposition of some of the component parts of an athletic shoe embodying the invention. Line 62 shows the interface between heel component 36 and forefoot component 38 (in a preferred embodiment, the interface between the PU and EVA which makes up the midsole); lines **64*a* and 64*b* show the outline of the PU wrap member 28; line 66 is the perimeter of insert member 42; and line 68 shows the rearmost boundary of cover 57**.

In another embodiment of the invention, the insert member may be completely encapsulated within the midsole so that there are no air spaces between the insert and the midsole. In yet another embodiment of the invention, the insert member may be partially encapsulated. For example, one side of the insert member may have midsole material filling the valleys in that side.

The foregoing description of the preferred embodiments of the invention has been presented for purposes of illustration and description. It is not intended to be exhaustive or to limit it to the precise form disclosed.

Obviously, many modifications and variations may be made in light of the above teachings. For example, although the drawings depict undulations which in cross-section are sinusoidal in shape, configurations in which the undulations have varying periods or amplitudes are also possible. Also, the positioning of the insert member need not necessarily be placed in the forefoot of an athletic shoe.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A sole for an athletic shoe comprising:

a. an outsole having a heel portion, and a metatarsal area, said heel portion including a central heel portion and a plurality of lugs forming the periphery of said heel portion for contacting the ground and maintaining said central heel portion at a spaced relationship from the ground; and b. a midsole disposed above said outsole and including a forefoot component which includes a forefoot foam member defining a recess; and an insert member disposed within said recess, said insert member being formed from a resilient material which tends to return to its original shape when deformed, said insert member comprising a plurality of undulations, wherein undulations spread laterally when compressed by vertical forces.

2. The sole as defined by claim 1, wherein said insert member includes a plurality of rows of undulations.

3. The sole of claim 2, wherein each row is substantially sinusoidal in cross-section.

4. The sole of claim 3, wherein each row is 180° out of phase from an adjacent row.

5. The sole as defined in claim 2 wherein said insert member comprises a plurality of substantially circular peaks and valleys.

6. The sole as defined in claim 1 wherein said insert is made from a thermoplastic material.

7. The sole as defined in claim 1, wherein said insert has a uniform local thickness.

8. A shoe, comprising:

a midsole;

an outsole; and an insert member positioned above said outsole, said insert member comprising a sheet of resilient material, said sheet having a plurality of substantially circular peaks forming a continuous quincunx arrangement and substantially circular valleys formed between the substantially circular peaks forming the corners of the quincunx arrangement, said circular peaks and circular valleys deforming laterally when compressed by vertical forces.

9. A shoe as set forth in claim 8, wherein said circular peaks are a uniform size.

10. A shoe as set forth in claim 8, wherein said sheet comprises a thermoplastic material.

11. A shoe as set forth in claim 8, wherein said insert member is positioned in the forefoot of said shoe between said outsole and said midsole.

12. A shoe as set forth in claim 8, wherein said insert member is at least partially encapsulated in said midsole.

13. An athletic shoe, comprising:

a midsole;

an outsole; and an insert member positioned above said outsole, said insert member comprising a sheet of resilient material, said sheet having a plurality of parallel rows of alternating peaks and valleys which have a substantially sinusoidal cross section, said rows being interleaved such that adjacent rows are 180° out of phase from each other, said rows of peaks and valleys deforming laterally when compressed by vertical forces.

14. A shoe as set forth in claim 13, wherein said sheet comprises a thermoplastic material.

15. A shoe as set forth in claim 13, wherein said peaks and valleys are substantially circular.

16. A shoe as set forth in claim 13, wherein said sheet has a uniform local thickness.

17. A shoe as set forth in claim 13, wherein said peaks have a substantially uniform height and said valleys have a substantially uniform depth.

18. A shoe as set forth in claim 13, wherein said insert member is at least partially encapsulated in said midsole.

19. A shoe as set forth in claim 1, wherein said insert member is at least partially encapsulated in said midsole.

* * * * *